US011346203B2

(12) United States Patent
Jamison et al.

(10) Patent No.: US 11,346,203 B2
(45) Date of Patent: May 31, 2022

(54) REAL-TIME MANAGEMENT OF EXCESSIVE TORQUE, DRAG, AND VIBRATION IN A DRILL STRING

(71) Applicant: HALLIBURTON ENERGY SERVICES, INC., Houston, TX (US)

(72) Inventors: Dale E. Jamison, Humble, TX (US); Robert L. Williams, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 51 days.

(21) Appl. No.: 16/641,493

(22) PCT Filed: Apr. 3, 2019

(86) PCT No.: PCT/US2019/025486
§ 371 (c)(1),
(2) Date: Feb. 24, 2020

(87) PCT Pub. No.: WO2020/204917
PCT Pub. Date: Oct. 8, 2020

(65) Prior Publication Data

US 2021/0148215 A1 May 20, 2021

(51) Int. Cl.
*E21B 44/04* (2006.01)
*E21B 21/08* (2006.01)

(52) U.S. Cl.
CPC ..... *E21B 44/04* (2013.01); *E21B 21/08* (2013.01)

(58) Field of Classification Search
CPC ..... E21B 44/04; E21B 21/08
See application file for complete search history.

(56) References Cited

U.S. PATENT DOCUMENTS 6,176,323 B1 * 1/2001 Weirich ..... E21B 31/03 175/40
7,908,034 B2 3/2011 Gray
2008/0083564 A1 * 4/2008 Collins ..... E21B 19/166 175/24
2009/0188718 A1 7/2009 Kaageson-Loe et al.
2009/0201170 A1 8/2009 Reckmann et al.
2010/0071910 A1 3/2010 Ellson et al.
2012/0046866 A1 2/2012 Meyer et al.
(Continued)

FOREIGN PATENT DOCUMENTS

WO 2011094689 A1 8/2011

OTHER PUBLICATIONS

"NOV's along-string measurement tool provides insight into wellbore stability", NOV-DDS-CH-1438-001, p. 1, 2016.
(Continued)

*Primary Examiner* — Giovanna Wright
(74) *Attorney, Agent, or Firm* — Kilpatrick Townsend & Stockton LLP

(57) ABSTRACT

Certain aspects and features of the present disclosure relate to real-time management of excessive torque, drag, and vibration along a drill string. In some aspects, torque, drag, vibration or any combination of these may be monitored at locations along the drill string, and these forces may be mitigated by adjusting the drilling fluid composition in real time. In some aspects, the forces may be mitigated by making real-time operational changes during wellbore drilling instead of or in addition to drilling fluid treatments.

20 Claims, 5 Drawing Sheets

(56) References Cited

U.S. PATENT DOCUMENTS

| | | | | |
|---|---|---|---|---|
| 2012/0130693 | A1 | 5/2012 | Ertas et al. | |
| 2013/0146294 | A1 | 6/2013 | Dupriest et al. | |
| 2018/0023355 | A1* | 1/2018 | Teodorescu ..... | E21B 21/06 175/40 |

OTHER PUBLICATIONS

"NOV's along-string measurement tool provides key information for well integrity", NOV-DDS-CH-1457-001, p. 1, 2016.
"NOV's stick-slip prevention service increases efficiency and helps protect drilling equipment", NOV-DDS-CH-1436-001, pp. 2, 2016.
PCT/US2019/025486, "International Search Report and Written Opinion", dated Jan. 14, 2020, 10 pages.

* cited by examiner

REAL-TIME MANAGEMENT OF EXCESSIVE TORQUE, DRAG, AND VIBRATION IN A DRILL STRING

TECHNICAL FIELD

The present disclosure relates generally to wellbore drilling. More specifically, but not by way of limitation, this disclosure relates to real-time management of excessive torque, drag, and vibration in a drilling tool during wellbore drilling.

BACKGROUND

A well includes a wellbore drilled through a subterranean formation. The conditions inside the subterranean formation where the drill bit is passing when the wellbore is being drilled continuously change. For example, the formation through which a wellbore is drilled exerts a variable force on the drill bit. This variable force can be due to the rotary motion of the drill bit, the weight applied to the drill bit, and the friction characteristics of each strata of the formation. A drill bit may pass through many different materials, such as rock, sand, shale, clay, etc., in the course of forming the wellbore and adjustments to various drilling parameters are sometimes made during the drilling process by a drill operator to account for observed changes.

BRIEF DESCRIPTION OF THE DRAWINGS

Illustrative aspects are described in detail herein with reference to the following drawing figures.

DETAILED DESCRIPTION

Figure 1:
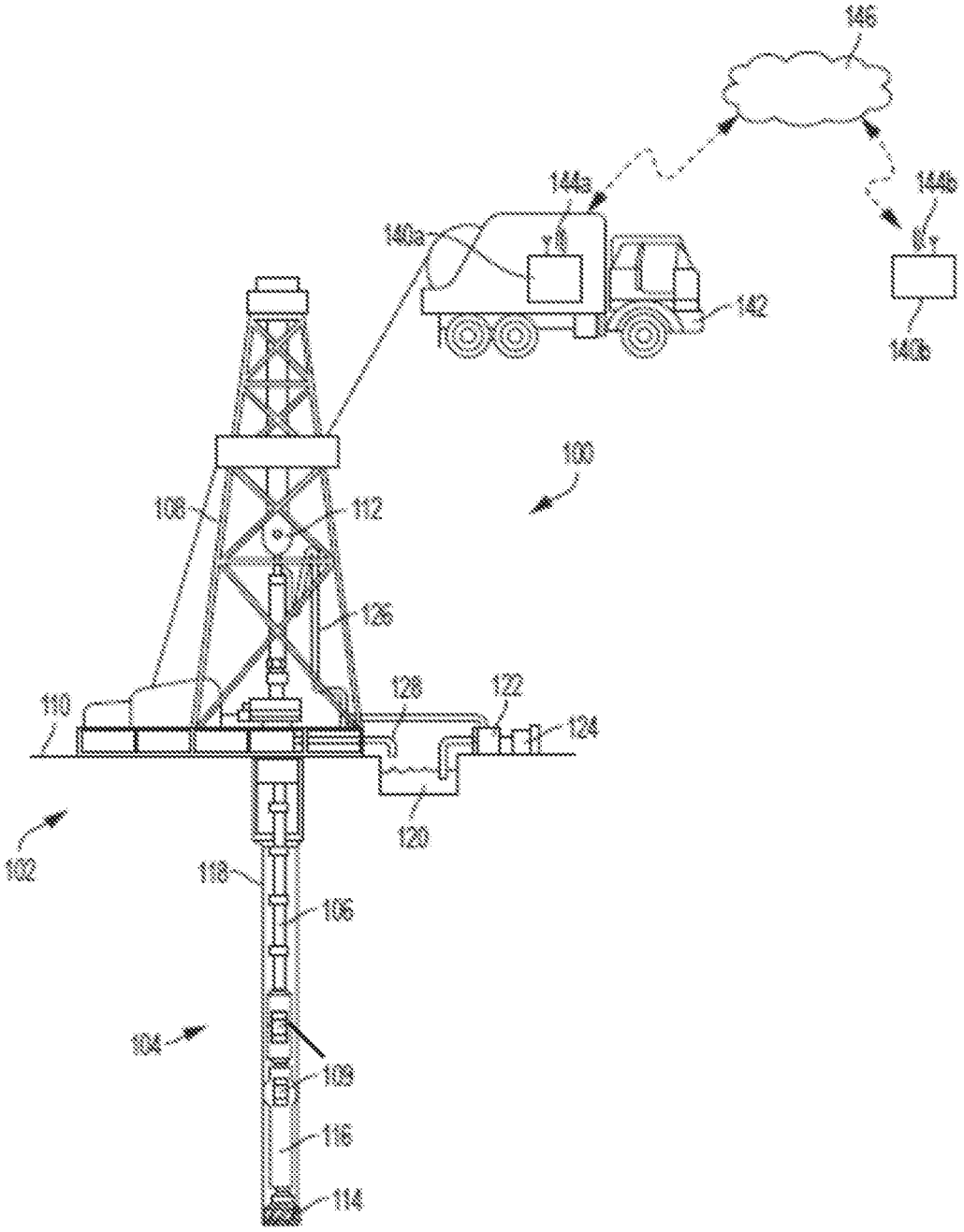
FIG. 1 is a cross-sectional view of an example of a drilling arrangement deployed at a well according to some aspects of the disclosure.

Certain aspects and features of the present disclosure relate to real-time management of excessive torque, drag, vibration or a combination of these occurring along a drill string. In some aspects, torque, drag, or vibration may be monitored at locations along the drill string, and these forces may be mitigated by adjusting the drilling fluid composition in order to alter the fluid composition around problematic locations on the drill string. Other changes, such as operational adjustments to the drilling tool during wellbore drilling, can also be made in real time to mitigate these forces.

A system according to some aspects includes a drilling tool and a computing device in communication with the drilling tool. The computing device includes a non-transitory memory device. The non-transitory memory device include instructions that are executable by the computing device to cause the computing device to monitor one or more of torque data, drag data, or vibration data associated with the drilling tool at various locations along drill string associated with the drilling tool while the drilling tool is operating in the wellbore. The computing device analyzes one or more of the torque data, the drag data, the vibration data or any combination of these at the locations to identify a location at which the torque data, drag data, or vibration data exceeds a threshold. The computing device also determines properties of fluid surrounding the drill string at the location and selects a remedial material to add to the drilling fluid, the wellbore, or both. The selection is based on the torque data, drag data, or vibration data at the location and on the properties of the fluid at the location.

Using examples of the present disclosure, real-time methods may be used to determine fluid lubricity. In addition, real-time methods may be used to prescribe and/or dose lubricants or other treatment products to treat torque and drag or vibration problems. Further, real-time methods may be used to manage drill string vibrations using fluid treatments in real time coupled with adjustments to drilling parameters such as weight-on-bit (WOB) and rate-of-penetration (ROP).

The fluid management system described herein may manage the drilling fluid composition and thus modify the drill pipe and wellbore interactions providing the opportunity to lower the cost of drilling by minimizing potential nonproductive time. For example, drill pipe or string fatigue and potential hardware failure may be avoided. If high fatigue is not avoided, the damaged section or components may require an extra trip out of the hole or even experience a catastrophic drill string component failure.

Potentially more impactful than a hardware failure is the damage done by the drill string to the formation. The constant and repeated high stress drill pipe interactions with the wellbore can cause wellbore instability, leading to wellbore caving or sloughing. If severe enough, these high stress interactions can even lead to a stuck pipe. The fluid management system described herein may reduce the magnitude of such damage.

In other examples, some cases of severe caving or sloughing can lead to the wellbore being overpressure, resulting in a lost circulation event. Poor hole quality can result in problems during completions and cementing. The systems described herein may help eliminate this problem. The systems described herein may also reduce excessive casing wear.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a drilling system 100 that may employ one or more principles of the present disclosure. A wellbore may be created by drilling into the earth 102 using the drilling system 100. The drilling system 100 may be configured to drive a bottom hole assembly (BHA) 104 positioned or otherwise arranged at the bottom of a drill string 106 extended into the earth 102 from a derrick 108 arranged at the surface 110. The derrick 108 includes a kelly 112 used to lower and raise the drill string 106. The BHA 104 may include a drill bit 114 operatively coupled to a drilling tool 116, which may be moved axially within a drilled wellbore 118 as attached to or part of drill string 106. In some examples, the drill string is or includes a wired pipe. The drill string may include one or more sensors 109 to determine conditions of the drill bit and wellbore, and return values for various parameters to the surface through the cabling (not shown) that is part of a wired pipe or by wireless signal. Sensors 109 can include, as an example, any sensor that produces a signal from which torque, drag, or both can be derived. One example of such as sensor is an accelerometer. The sensors can also include a lubricity sensor. The combination of any support structure (in this example, derrick 108), any motors, electrical connections, and support for the drill string and tool string may be referred to herein as a drilling arrangement.

During operation, the drill bit 114 penetrates the earth 102 and thereby creates the wellbore 118. The BHA 104 provides control of the drill bit 114 as it advances into the earth 102. Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles (not shown) arranged in the drill bit 114 and in the process cools the drill bit 114. After exiting the drill bit 114, the mud circulates back to the surface 110 via the annulus defined between the wellbore 118 and the drill string 106, and in the process returns drill cuttings and debris to the surface. The cuttings and mud mixture are passed through a flow line 128 and are processed such that a cleaned mud is returned down hole through the stand pipe 126 once again.

Still referring to FIG. 1, the drilling arrangement and any sensors 109 (through the drilling arrangement or directly) are connected to a computing device 140*a*. In FIG. 1, the computing device 140*a* is illustrated as being deployed in a work vehicle 142, however, a computing device to receive data from sensors 109 and control drilling tool 116 and hence drill bit 114 can be permanently installed with the drilling arrangement, be hand-held, or be remotely located. The computing device 140*a* in some aspects can control the drilling tool 116 to select changes in operation of the drilling tool in response to torque, drag, or vibration exceeding certain thresholds. The computing device in some aspects can also control the addition of remedial material to the wellbore using mud pump 122. In some examples, the computing device 140*a* can process at least a portion of the data received and can transmit the processed or unprocessed data to another computing device 140*b* via a wired or wireless network 146. The other computing device 140*b* can be offsite, such as at a data-processing center. The other computing device 140*b* can receive the data, execute computer program instructions to determine parameters to apply to the drill bit, and communicate those parameters to computing device 140*a*.

The computing devices 140*a-b* can be positioned belowground, aboveground, onsite, in a vehicle, offsite, etc. The computing devices 140*a-b* can include a processor interfaced with other hardware via a bus. A memory, which can include any suitable tangible (and non-transitory) computer-readable medium, such as RAM, ROM, EEPROM, or the like, can embody program components that configure operation of the computing devices 140*a-b*. In some aspects, the computing devices 140*a-b* can include input/output interface components (e.g., a display, printer, keyboard, touch-sensitive surface, and mouse) and additional storage.

The computing devices 140*a-b* can include communication devices 144*a-b*. The communication devices 144*a-b* can represent one or more of any components that facilitate a network connection. In the example shown in FIG. 1, the communication devices 144*a-b* are wireless and can include wireless interfaces such as IEEE 802.11, Bluetooth, or radio interfaces for accessing cellular telephone networks (e.g., transceiver/antenna for accessing a COMA, GSM, UMTS, or other mobile communications network). In some examples, the communication devices 144*a-b* can use acoustic waves, surface waves, vibrations, optical waves, or induction (e.g., magnetic induction) for engaging in wireless communications. In other examples, the communication devices 144*a-b* can be wired and can include interfaces such as Ethernet, USB, IEEE 1394, or a fiber optic interface. The computing devices 140*a-b* can receive wired or wireless communications from one another and perform one or more tasks based on the communications.

Figure 2:
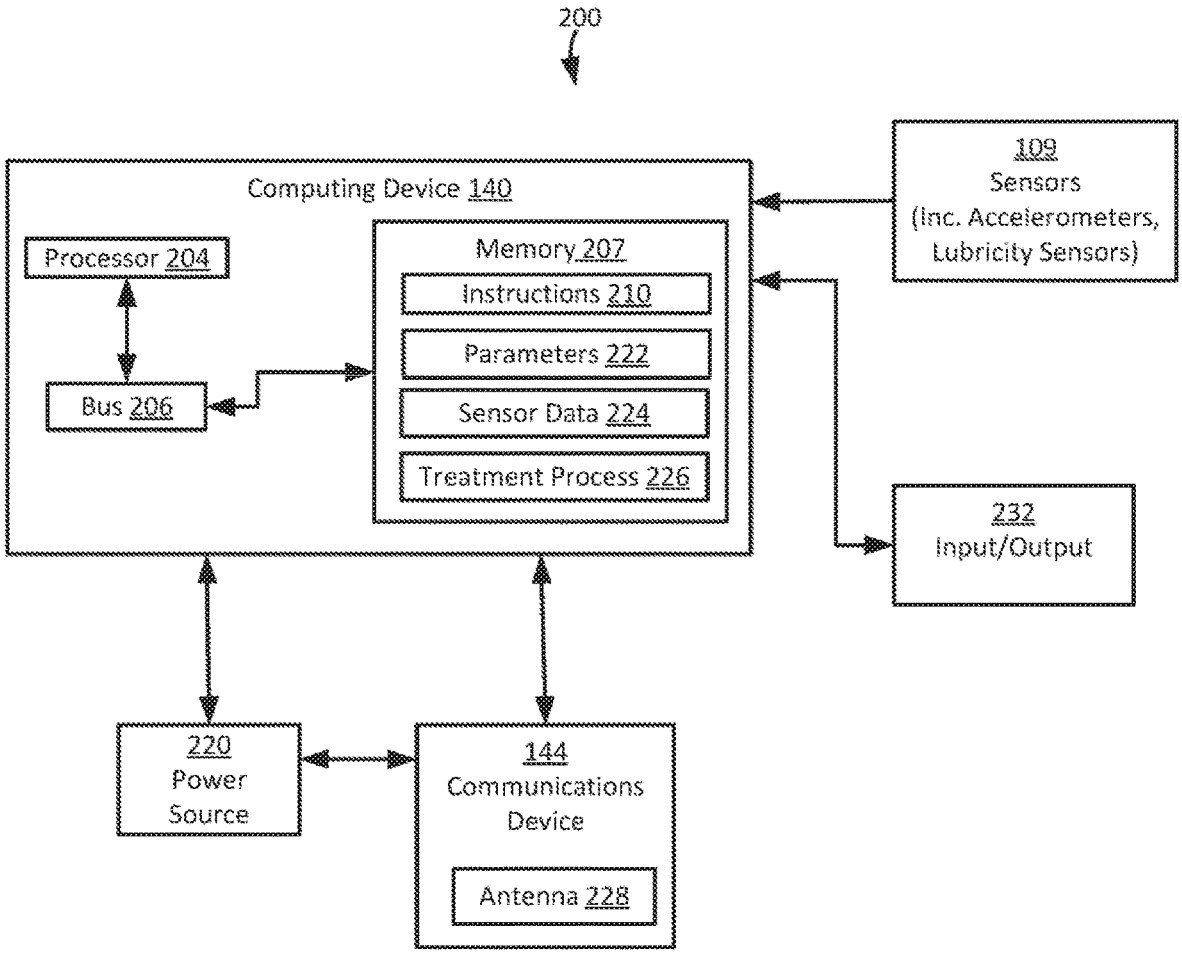
FIG. 2 is block diagram of a computing device for managing forces on a drilling tool according to some aspects of the disclosure.

FIG. 2 is a block diagram of a computing system 200 for real-time monitoring of torque according to some aspects of the disclosure. In some examples, the components shown in FIG. 2 (e.g., the computing device 140, power source 220, and communications device 144) can be integrated into a single structure. For example, the components can be within a single housing. In other examples, the components shown in FIG. 2 can be distributed (e.g., in separate housings) and in electrical communication with each other.

The system 200 includes the computing device 140. The computing device 140 includes a processor 204, a memory 207, and a bus 206. The processor 204 can execute one or more operations for obtaining measurements of torque, drag, and vibration, and comparing values obtained to thresholds. The processor 204 can execute instructions stored in the memory 207 to perform the operations. The processor 204 can include one processing device or multiple processing devices. Non-limiting examples of the processor 204 include a Field-Programmable Gate Array ("FPGA"), an application-specific integrated circuit ("ASIC"), a microprocessor, etc.

The processor 204 can be communicatively coupled to the memory 207 via the bus 206. The non-volatile memory 207 may include any type of memory device that retains stored information when powered off. Non-limiting examples of the memory 207 include electrically erasable and programmable read-only memory ("EEPROM"), flash memory, or any other type of non-volatile memory. In some examples, at least part of the memory 207 can include a medium from which the processor 204 can read instructions. A non-transitory computer-readable medium can include electronic, optical, magnetic, or other storage devices capable of providing the processor 204 with computer-readable instructions or other program code. Non-limiting examples of a non-transitory computer-readable medium include (but are not limited to) magnetic disk(s), memory chip(s), ROM, random-access memory ("RAM"), an ASIC, a configured processor, optical storage, or any other persistent medium from which a computer processor can read instructions. The instructions can include processor-specific instructions generated by a compiler or an interpreter from code written in any suitable computer-programming language, including, for example, C, C++, C#, etc.

In some examples, the memory 207 can include computer program instructions 210 for determining and executing a treatment process and injecting remediation material into the wellbore or adding remediation material to the drilling fluid. Instructions 210 can also derive torque, drag, vibration, or any combination of these from signals coming from sensors 109, which in the example of FIG. 2 are accelerometers. The current treatment process 226 as well as a library of potential treatment processes can be stored in memory 207. The treatment process, in addition to injecting material into the wellbore, can include changing the parameters 222 used to control the drilling tool. Parameters 222 are also stored in memory 207 of system 200. The system 200 can include a power source 220. The power source 220 can be in electrical communication with the computing device 140 and the communications device 144. In some examples, the power source 220 can include a battery or an electrical cable (e.g., a wireline). In some examples, the power source 220 can include an AC signal generator. The computing device 140 can operate the power source 220 to apply a transmission signal to the antenna 228 to forward cutting concentration data to other systems. For example, the computing device 140 can cause the power source 220 to apply a voltage with a frequency within a specific frequency range to the antenna 228. This can cause the antenna 228 to generate a wireless transmission. In other examples, the computing device 140, rather than the power source 220, can apply the transmission signal to the antenna 228 for generating the wireless transmission.

In some examples, part of the communications device 144 can be implemented in software. For example, the communications device 144 can include additional instructions stored in memory 207 for controlling the functions of communication device 144. The communications device 144 can receive signals from remote devices and transmit data to remote devices (e.g., the computing device 140*b* of FIG. 1). For example, the communications device 144 can transmit wireless communications that are modulated by data via the antenna 228. In some examples, the communications device 144 can receive signals (e.g., associated with data to be transmitted) from the processor 204 and amplify, filter, modulate, frequency shift, and otherwise manipulate the signals. In some examples, the communications device 144 can transmit the manipulated signals to the antenna 228. The antenna 228 can receive the manipulated signals and responsively generate wireless communications that carry the data.

The computing system 200 can receive input data from sensor(s) 109, including accelerometers placed along the drill string. This sensor data 224 can be stored in memory 207. Computer system 200 in this example also includes input/output interface 232. Input/output interface 232 can connect to a keyboard, pointing device, display, and other computer input/output devices. An operator may provide input using the input/output interface 232. Torque, drag and vibration values or other data related to the operation of the system can also be displayed to an operator through a display that is connected to or is part of input/output interface 232. Sensors 109 can also include lubricity sensors to measure the properties of fluid at locations along the drill string. However, these fluid properties can also be determined from modeling the drill string and its environment, which can be accomplished in some aspects by executing instructions 210.

Figure 3:
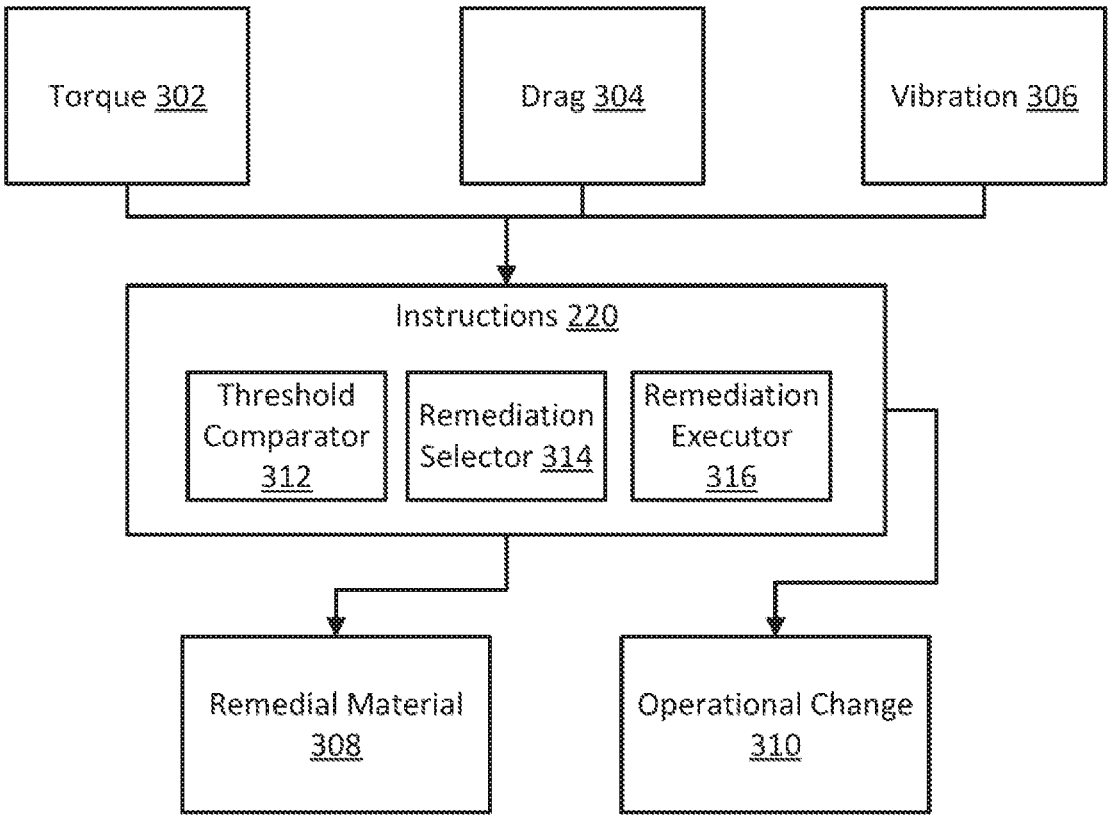
FIG. 3 is a block diagram of a system for managing forces on a drilling tool according to some aspects of the disclosure.

FIG. 3 is a block diagram of another example of a system for managing forces on a drilling tool according to some aspects. Computer program instructions 210 can be executed by a processor to change drilling parameters, such as to make operational changes 310 or to cause remedial fluid 308 to be inserted downhole either separately, or by adding it to fluid such as drilling mud from mud tank 120 of FIG. 1.

Torque data 302, drag data 304, and/or vibration data 306 may be received or determined by the computing device in some aspects. In some aspects, raw acceleration data measured at the surface or downhole, or any other surface or downhole data, may be received processor 204 executing computer program instructions 210, and the processor can derive at least one of the torque data 302, the drag data 304, and/or the vibration data 306.

Instructions 210 may include a number of modules stored in or on computer-readable media to as to be accessible and executable by the processor 204. The modules may include a threshold comparator 312, a remediation selector 314, and a remediation executor 316. The threshold comparator 312 may compare the torque data 302, the drag data 304, and/or the vibration data 306 to a threshold. The threshold may be selected based on any desired effects, such as decreased chance of damage to the drilling tool, higher efficiency, etc. An appropriate selection can be entered by an operator using I/O interface 232.

If one or more of the torque data 302, the drag data 304, or the vibration data 306 is above the threshold, the remediation selector 314 may determine whether one or more operational changes should be executed or a remedial material 308 should be added to the fluid or inserted into the wellbore. The remediation selector 314 may produce a treatment process that defines the order in which the operational change 310, the remedial material 308, or both should be executed. The remediation selector 314 may further select the type of operational change 310, the type and amount of remedial material 308 to be added or both.

The remediation executor 316 may follow the treatment process defined by the remediation selector to cause remedial material 308 to be inserted downhole at a particular location, to cause an operational change 310 in the control of the drilling tool, or both. In an example where the remedial material 308 or the operational change 310 (or both) can be executed automatically, the remediation executor 316 may form computer-generated instructions to cause computing device 140 or some other computing device or devices to change drilling parameters or inject remedial material. In examples in which either the injection of remedial material 308 or the operational change 310 cannot be executed automatically, the remediation executor 316 may form and transmit or display a notification delineating the treatment process to an operator, such as a drilling engineer. This notification can, as an example, be displayed through I/O interface 232.

Figure 4:
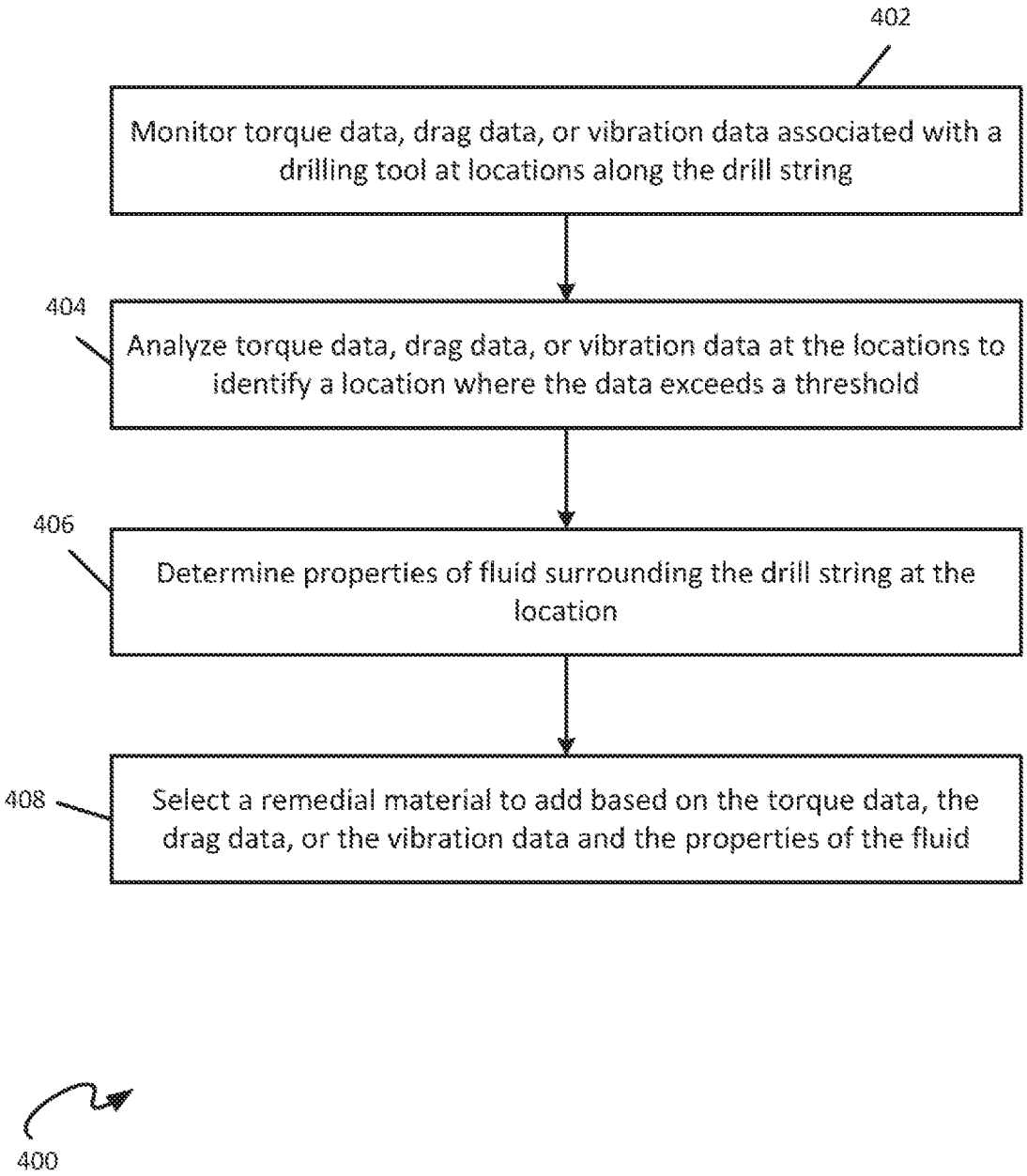
FIG. 4 is an example of a flowchart of a process for managing forces on a drilling tool according to some aspects of the disclosure.

FIG. 4 is a flowchart illustrating an example of a process 400 for managing forces on a drilling tool according to some aspects. Some examples can include more, fewer, or different blocks than those shown in FIG. 4. The blocks shown in FIG. 4 can be implemented using, for example, one or more of the computing devices described and shown herein.

At block 402, data associated with a drilling tool is monitored along the drill string. The data can include torque data, drag data, vibration data, or a combination of any or all of these. Any or all of this data may be monitored directly or derived from one or more sensors affixed to the drill string 106 (including drilling tool 116). At block 404, the data from multiple locations is analyzed by processor 204 to identify any location where the data exceeds a threshold. The threshold may be selected based on, for example, whether damages, errors, or inefficiencies are likely to occur based on the torque, drag, and vibration data. At block 406, properties of fluid surrounding the drilling tool are determined by measuring the fluid or modeling the drill string at the location. A combination of measurements and modeling can also be used. As an example, the lubricity of the fluid may be measured by a lubricity sensor, producing lubricity data that is collected uphole by computing device 140.

Still referring to FIG. 4, at block 408, a remedial material is selected to add to the wellbore or the drilling fluid based on one or more of the torque data, the drag data, or the vibration data and the properties of the fluid. In some aspects, the remedial material is caused to be inserted downhole separately. The remedial material may be, for example, solid or wet lubricants, viscosifiers/thinners, wetting agents, weighing materials, lost-circulation materials (LCMs), or any other material that may lower the effects of the contact stresses of the filling tool to the wellbore or casing. In some aspects, the remedial material is added automatically. In some aspects, the remedial material is added by causing instructions displayed to an operator, such as a drilling engineer. This instruction can be displayed locally, such as through I/O interface 232, or sent to a remote location, such as through wireless network 146.

In some aspects, a change in operation of the drilling tool may also be made. Exemplary changes in operation include change in weight-on-bit (WOB), change in drill bit speed, and the like. The change in operation of the drilling tool can be caused automatically in some aspects by generating and sending instructions to a controller. In some aspects, the change in operation of the drilling tool may be changed manually, through instructions displayed to an operator, such as a drilling engineer, and executed by being input through I/O interface 232 of computing device 140.

In some aspects, an operational change of the drilling tool may be selected. A treatment process for the remedial material and the operational change may be generated. The treatment process may define an order of application of the remedial material and the operational change. The treatment process may be carried out in the order defined. Application of the treatment may include adding or inserting the remedial material separately down hole and adjusting the drilling tool in accordance with the operational change. Treatment may also include adding the remedial material to the drilling fluid. If the remedial material is added to the drilling fluid, the drilling fluid may become a homogeneous mix of the original drilling fluid components and the remedial material. The operational change will be discussed further below with reference to FIG. 5.

Figure 5:
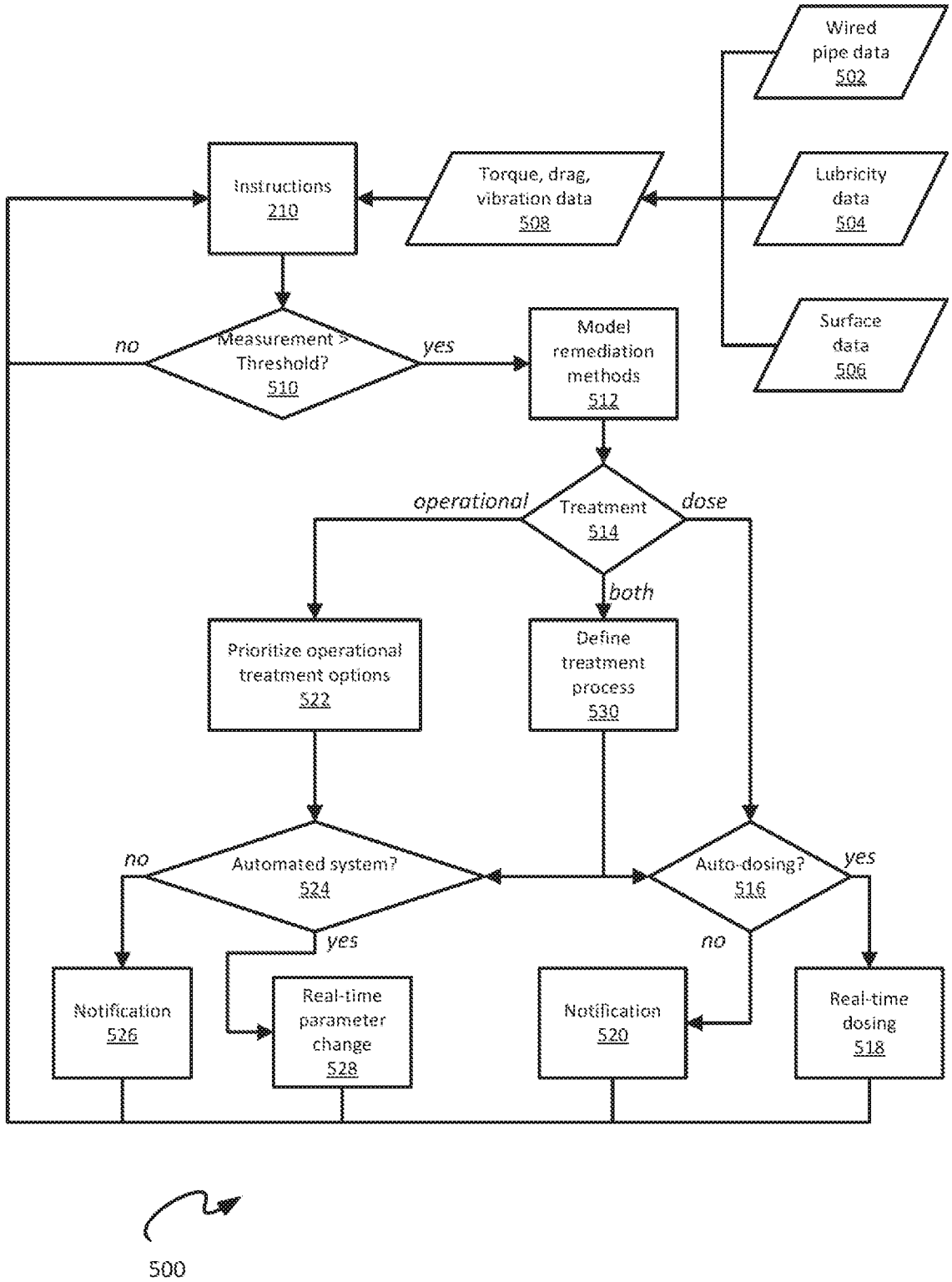
FIG. 5 is a flowchart of another process for managing forces on a drilling tool according to some aspects of the disclosure.

FIG. 5 is a flowchart of a process 500 for managing forces on a drilling tool according to some aspects of the disclosure. Some examples can include more, fewer, or different blocks than those shown in FIG. 5. The blocks shown in FIG. 5 can be implemented using, for example, one or more of the computing devices described and shown herein.

In FIG. 5, a variety of data may be collected, including wired pipe data 502, lubricity data 504, and surface data 506. A wired pipe is a drill string with wiring for signaling, including for sending information from sensors located downhole to a surface computer system. The wired pipe data 502 may be collected from downhole sensors positioned on the wired pipe (drill string). At one example, these sensors include accelerometers. In some aspects, lubricity data may be collected from a lubricity sensor and multiple lubricity sensors can be located along the wired pipe. Surface data may include any information measured at the surface of the formation (i.e., as opposed to downhole data). Examples of surface data include torque and vibration data from the drilling arrangement and flow rates of mud or other fluids The wired pipe data 502, lubricity data 504, and surface data 506 may be analyzed to derive one or more of torque, drag, or vibration data 508.

One or more of the torque, drag, or vibration data 508 in FIG. 5 may be provided to the computing device and processed by the computer program instructions 210 running on processor 204. Processor 204 may determine whether any of the data is above a threshold at block 510. The threshold may be selected based on, for example, whether damages, mistakes, or inefficiencies are likely to occur based on the one or more of the torque, drag, or vibration data. Many types of damage may occur based on one or more of torque, drag, or vibration being above a threshold. For example, drilling tool fatigue and hardware damage may be encountered. In the case of high fatigue, the damaged section or components may require an extra tip out of the hole or even a component replacement. In another example, the drill string may cause too much damage to the formation. The constant and repeated high stress drill pipe interactions with the well bore can cause wellbore instability leading to wellbore caving or sloughing. If severe enough, the stress can also lead to stuck pipe. Some cases of severe caving or sloughing can lead to the wellbore being overpressure, resulting in a lost circulation event. In addition, poor hole quality can result in problems during completions and cementing.

Still referring to FIG. 5, if all of the torque, drag, or vibration data 508 are below a threshold, the computer program instructions 210 cause processor 204 continue to monitor one or more of the torque, drag, or vibration data 508 in real time. If one or more of the torque, drag, or vibration data is above a threshold, the processor 204 models remediation methods at block 512. Remediation methods may include either making an operational change, adding remedial material to the wellbore, or both. The treatment is determined at block 514. If treatment includes an operational change, operational treatment options are prioritized at block 522. For example, the operational treatment options may include decreasing WOB and decreasing drill speed. At block 522, these options are be prioritized when they cannot be executed in tandem or if only one of those options is required to address the issue. At block 524, processor 204 determines whether the drilling tool is controlled by an automated system. If it is not controlled by an automated system, a notification is generated at block 526 and transmitted or displayed to an operator, such as a drilling engineer, regarding what operational changes need to be made. The processor under control of computer program instructions 210 may continue to monitor data 508 after the operational changes are made to determine whether additional changes need to be made. If the drilling tool is controlled by an automated system, a real-time parameter change may be made automatically at block 528. The processor 204 may continue to monitor the data 508 after the operational changes are made to determine whether additional changes need to be made.

Continuing with FIG. 5, if the treatment determined at block 514 includes a dosing of remedial material downhole, a determination is made at block 516 as to whether the drilling tool has an automated dosing system. If it does not have an automated dosing system, a notification is generated at block 520 and displayed to or transmitted to an operator, such as a drilling engineer, regarding the remedial dosing to be executed. The processor may continue to monitor data 508 after the dosing is complete to determine whether additional dosing needs to be carried out. If the drilling tool is controlled by an automated system, real-time dosing is executed automatically at block 518. The processor may continue to monitor the data 508 after the dosing changes are made to determine whether additional changes need to be made. There may be a time lag between adding remedial material to the system and seeing the effects of the remedial material downhole or back at the surface.

If treatment as shown in FIG. 5 includes both an operational change and a dosing of remedial materials downhole, a treatment process is defined at block 530. The treatment process may determine the order in which the treatment processes should be carried out, if they cannot or should not be executed simultaneously. At block 524, processor 204 determines whether the drilling tool is controlled by an automated system. If it is not controlled by an automated system, the notification is generated at block 526. If the drilling tool is controlled by an automated system, a real-time parameter change may be made automatically at block 528. At block 516, the processor determines whether the drilling tool has an automated dosing system. If it does not have an automated dosing system, a notification is generated at block 520 and displayed or transmitted to an operator, such as a drilling engineer, regarding the remedial dosing to be executed. If the drilling tool has an automated dosing system, real-time dosing is executed automatically at block 518. The processor may continue to monitor the data 508 after the actions are taken or the changes are made to determine whether additional measures need to be taken.

Operational changes can include changes to drill pipe rotation speed, mud motor speed, pump flow rate, ROP, weight-on-bit (WOB), directional drilling parameters such as inclination and azimuth, and relative drilling and sliding times. Remediation can include hole cleaning methods. For example, a "pump and rotate" (pump rate, rotation speed and duration are set with ROP=0) to clear portions of the wellbore of cuttings. If the hole is tripped out, the drill bit configuration can be changed.

Terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" or "comprising," when used in this specification, specify the presence of stated features, steps, operations, elements, or components, but do not preclude the presence or addition of one or more other features, steps, operations, elements, components, or groups thereof. Additionally, comparative, quantitative terms such as "above," "below," "less," and "greater" are intended to encompass the concept of equality, thus, "less" can mean not only "less" in the strictest mathematical sense, but also, "less than or equal to."

Unless specifically stated otherwise, it is appreciated that throughout this specification that terms such as "processing," "calculating," "determining," "operations," or the like refer to actions or processes of a computing device, such as the controller or processing device described herein, that can manipulate or transform data represented as physical electronic or magnetic quantities within memories, registers, or other information storage devices, transmission devices, or display devices. The order of the process blocks presented in the examples above can be varied, for example, blocks can be re-ordered, combined, or broken into sub-blocks. Certain blocks or processes can be performed in parallel. The use of "configured to" herein is meant as open and inclusive language that does not foreclose devices configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Elements that are described as "connected," "connectable," or with similar terms can be connected directly or through intervening elements.

In some aspects, a system for monitoring drill cuttings is provided according to one or more of the following examples. As used below, any reference to a series of examples is to be understood as a reference to each of those examples disjunctively (e.g., "Examples 1-4" is to be understood as "Examples 1, 2, 3, or 4").

Example 1. A system includes a drilling tool, and a computing device in communication with the drilling tool. The computing device includes a non-transitory memory device further including instructions that are executable by the computing device to cause the computing device to perform operations. The operations include monitoring at least one of torque data, drag data, or vibration data associated with the drilling tool at locations along a drill string including the drilling tool in a wellbore, analyzing the at least one of torque data, drag data, or vibration data at the locations to identify a location of the locations at which the at least one of torque data, drag data, or vibration data exceeds a threshold, determining properties of fluid surrounding the drill string at the location, and selecting a remedial material to add to at least one of the wellbore or the fluid based on the at least one of torque data, drag data, or vibration data at the location and the plurality of properties of the fluid at the location.

Example 2. The system of example 1, wherein the operations further include causing the remedial material to be added to the wellbore, the fluid, or both.

Example 3. The system of example(s) 1-2, wherein the remedial material is added automatically.

Example 4. The system of example(s) 1-3, wherein the properties of the fluid includes lubricity data.

Example 5. The system of example(s) 1-4 further includes one or more sensors affixed to the drill string, wherein the at least one of torque data, drag data, or vibration data is derived from the one or more sensors.

Example 6. The system of example(s) 1-5, wherein the operations further include selecting a change in operation of the drilling tool.

Example 7. The system of example(s) 1-6, wherein the operations further include causing a change in operation on the drilling tool.

Example 8. The system of example(s) 1-7, wherein the operations further include selecting an operational change of the drilling tool, generating a treatment process for the remedial material and the operational change, wherein the treatment process defines an order for execution of adding the remedial material and the operational change, and executing the treatment process in the order for execution, wherein executing the treatment process includes adding the remedial material and adjusting the drilling tool in accordance with the operational change.

Example 9. A method includes monitoring at least one of torque data, drag data, or vibration data associated with a drilling tool at a locations along a drill string including the drilling tool in a wellbore, analyzing the at least one of torque data, drag data, or vibration data at the locations to identify a location of the locations at which the at least one of torque data, drag data, or vibration data exceeds a threshold, determining properties of fluid surrounding the drill string at the location, and selecting a remedial material to add to at least one of the wellbore or the fluid based on the at least one of torque data, drag data, or vibration data at the location and the plurality of properties of the fluid at the location.

Example 10. The method of example(s) 9 further includes causing the remedial material to be added to the wellbore, the fluid, or both.

Example 11. The method of example(s) 9-10, wherein the remedial material is added automatically.

Example 12. The method of example(s) 9-11, wherein the properties of the fluid include lubricity data.

Example 13. The method of example(s) 9-12 wherein the at least one of torque data, drag data, or vibration data is derived from one or more sensors affixed to the drill string.

Example 14. The method of example(s) 9-13 further includes selecting a change in operation of the drilling tool.

Example 15. The method of example(s) 9-14 further includes selecting an operational change of the drilling tool, generating a treatment process for the remedial material and the operational change, wherein the treatment process defines an order for execution of adding the remedial material and the operational change, and executing the treatment process in the order for execution, wherein executing the treatment process includes adding the remedial material and adjusting the drilling tool in accordance with the operational change.

Example 16. A non-transitory computer-readable medium includes instructions that are executable by a processing device for causing the processing device to perform operations. The operations includes monitoring at least one of torque data, drag data, or vibration data associated with a drilling tool at locations along a drill string including the drilling tool in a wellbore, analyzing the at least one of torque data, drag data, or vibration data at the locations to identify a location of the locations at which the at least one of torque data, drag data, or vibration data exceeds a threshold; determining properties of fluid surrounding the drill string at the location, and selecting a remedial material to add to at least one of the wellbore or the fluid based on the at least one of torque data, drag data, or vibration data at the location and the properties of the fluid at the location.

Example 17. The non-transitory computer-readable medium of example(s) 16, wherein the operations further include causing the remedial material to be added to the wellbore, the fluid, or both.

Example 18. The non-transitory computer-readable medium of example(s) 16-17, wherein the remedial material is added automatically.

Example 19. The non-transitory computer-readable medium of example(s) 16-18, wherein the at least one of torque data, drag data, or vibration data is derived from one or more sensors affixed to the drill string.

Example 20. The non-transitory computer-readable medium of example(s) 16-19, wherein the operations further include selecting an operational change of the drilling tool, generating a treatment process for the remedial material and the operational change, wherein the treatment process defines an order for execution of adding the remedial material and the operational change, and executing the treatment process in the order for execution, wherein executing the treatment process includes adding the remedial material and adjusting the drilling tool in accordance with the operational change.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A system comprising:

a drilling tool; and a computing device in communication with the drilling tool, the computing device including a non-transitory memory device comprising instructions that are executable by the computing device to cause the computing device to perform operations comprising:

monitoring at least one of torque data, drag data, or vibration data associated with the drilling tool at a plurality of locations along a drill string including the drilling tool in a wellbore;

analyzing the at least one of torque data, drag data, or vibration data at the plurality of locations to identify a location of the plurality of locations at which the at least one of torque data, drag data, or vibration data exceeds a threshold;

based on identifying the location, determining a plurality of properties of fluid surrounding the drill string at the location, the plurality of properties of the fluid being determined based on sensor signals from one or more sensors positioned on the drill string proximate to the location; and selecting a remedial material to add to at least one of the wellbore or the fluid based on both of: (1) the at least one of torque data, drag data, or vibration data at the location and (2) the plurality of properties of the fluid at the location.

2. The system of claim 1, wherein the operations further comprise:

causing the remedial material to be added to the wellbore, the fluid, or both.

3. The system of claim 2, wherein the remedial material is added automatically.

4. The system of claim 1, wherein the plurality of properties of the fluid includes lubricity data.

5. The system of claim 1, further comprising one or more sensors affixed to the drill string, wherein the at least one of torque data, drag data, or vibration data is derived from the one or more sensors.

6. The system of claim 1, wherein the operations further include:

selecting a change in operation of the drilling tool.

7. The system of claim 6, wherein the operations further include causing a change in operation on the drilling tool.

8. The system of claim 1, wherein the operations further include:

selecting an operational change of the drilling tool;

generating a treatment process for the remedial material and the operational change, wherein the treatment process defines an order for execution of adding the remedial material and the operational change; and executing the treatment process in the order for execution, wherein executing the treatment process includes adding the remedial material and adjusting the drilling tool in accordance with the operational change.

9. A method comprising:

monitoring at least one of torque data, drag data, or vibration data associated with a drilling tool at a plurality of locations along a drill string including the drilling tool in a wellbore;

analyzing the at least one of torque data, drag data, or vibration data at the plurality of locations to identify a location of the plurality of locations at which the at least one of torque data, drag data, or vibration data exceeds a threshold;

based on identifying the location, determining a plurality of properties of fluid surrounding the drill string at the location, the plurality of properties of the fluid being determined based on sensor signals from one or more sensors positioned on the drill string proximate to the location; and selecting a remedial material to add to at least one of the wellbore or the fluid based on both of: (1) the at least one of torque data, drag data, or vibration data at the location and (2) the plurality of properties of the fluid at the location.

10. The method of claim 9, further comprising causing the remedial material to be added to the wellbore, the fluid, or both.

11. The method of claim 10, wherein the remedial material is added automatically.

12. The method of claim 9, wherein the plurality of properties of the fluid includes lubricity data.

13. The method of claim 9, wherein the at least one of torque data, drag data, or vibration data is derived from one or more sensors affixed to the drill string.

14. The method of claim 9, further comprising selecting a change in operation of the drilling tool.

15. The method of claim 9, further comprising:

selecting an operational change of the drilling tool;

generating a treatment process for the remedial material and the operational change, wherein the treatment process defines an order for execution of adding the remedial material and the operational change; and executing the treatment process in the order for execution, wherein executing the treatment process includes adding the remedial material and adjusting the drilling tool in accordance with the operational change.

16. A non-transitory computer-readable medium that includes instructions that are executable by a processing device for causing the processing device to perform operations comprising:

monitoring at least one of torque data, drag data, or vibration data associated with a drilling tool at a plurality of locations along a drill string including the drilling tool in a wellbore;

analyzing the at least one of torque data, drag data, or vibration data at the plurality of locations to identify a location of the plurality of locations at which the at least one of torque data, drag data, or vibration data exceeds a threshold;

based on identifying the location, determining a plurality of properties of fluid surrounding the drill string at the location, the plurality of properties of the fluid being determined based on sensor signals from one or more sensors positioned on the drill string proximate to the location; and selecting a remedial material to add to at least one of the wellbore or the fluid based on both of: (1) the at least one of torque data, drag data, or vibration data at the location and (2) the plurality of properties of the fluid at the location.

17. The non-transitory computer-readable medium of claim 16, wherein the operations further comprise causing the remedial material to be added to the wellbore, the fluid, or both.

18. The non-transitory computer-readable medium of claim 17, wherein the remedial material is added automatically.

19. The non-transitory computer-readable medium of claim 16, wherein the at least one of torque data, drag data, or vibration data is derived from one or more sensors affixed to the drill string.

20. The non-transitory computer-readable medium of claim 16, wherein the operations further comprise:

selecting an operational change of the drilling tool;

generating a treatment process for the remedial material and the operational change, wherein the treatment process defines an order for execution of adding the remedial material and the operational change; and executing the treatment process in the order for execution, wherein executing the treatment process includes adding the remedial material and adjusting the drilling tool in accordance with the operational change.

* * * * *